US010626864B2

(12) United States Patent
Santa

(10) Patent No.: US 10,626,864 B2
(45) Date of Patent: Apr. 21, 2020

(54) PRESSURISED FLUID DRIVEN DIAPHRAGM PUMP ASSEMBLY

(71) Applicant: JOE SANTA & ASSOCIATES PTY LIMITED, Toronto West, New South Wales (AU)

(72) Inventor: David Luiz Santa, Jewells (AU)

(73) Assignee: JOE SANTA & ASSOCIATES PTY LIMITED, NSW (AU)

( * ) Notice: Subject to any disclaimer, the term of this patent is extended or adjusted under 35 U.S.C. 154(b) by 0 days.

(21) Appl. No.: 15/113,938

(22) PCT Filed: Dec. 9, 2014

(86) PCT No.: PCT/AU2014/001106

§ 371 (c)(1),
(2) Date: Jul. 25, 2016

(87) PCT Pub. No.: WO2015/143472

PCT Pub. Date: Oct. 1, 2015

(65) Prior Publication Data

US 2017/0009765 A1 Jan. 12, 2017

(30) Foreign Application Priority Data

Mar. 26, 2014 (AU) ..... 2014901080

(51) Int. Cl.
*F04B 43/073* (2006.01)
*F04B 53/10* (2006.01)
(Continued)

(52) U.S. Cl.
CPC ..... *F04B 53/1087* (2013.01); *F04B 1/02* (2013.01); *F04B 9/129* (2013.01); *F04B 43/06* (2013.01);
(Continued)

(58) Field of Classification Search
CPC ..... F04B 9/133; F04B 43/0736; F04B 43/02; F04B 45/0536; F04B 53/16
See application file for complete search history.

(56) References Cited

U.S. PATENT DOCUMENTS 2,318,128 A * 5/1943 Tabb ..... F04B 43/0054 417/542
2,798,440 A * 7/1957 Hall ..... F02M 1/00 417/393
(Continued)

FOREIGN PATENT DOCUMENTS

WO WO2010/123965 10/2010

OTHER PUBLICATIONS

PCT Search Report and Written Opinion for PCT/AU2014/001106, completed Jan. 15, 2015.
(Continued)

*Primary Examiner* — Charles G Freay
*Assistant Examiner* — Thomas Fink
(74) *Attorney, Agent, or Firm* — Barnes & Thornburg LLP

(57) ABSTRACT

A pump assembly (10) that is provided with compressed air to drive the pump. The pump assembly (10) includes a pair of chambers (11, 12), with each of the chambers (11, 12) being divided into sub-chambers (13, 14 and 15, 16). A piston assembly (17) divides the chamber (11) into sub-chambers (13 and 14), while a second piston assembly (18) divides the chamber (12) into sub-chambers (15 and 16).

16 Claims, 4 Drawing Sheets

(51) Int. Cl.

| | |
|---|---|
| ***F04B 45/053*** | (2006.01) |
| ***F04B 43/06*** | (2006.01) |
| ***F04B 1/02*** | (2006.01) |
| ***F04B 9/129*** | (2006.01) |
| ***F04B 53/14*** | (2006.01) |
| ***F04B 53/16*** | (2006.01) |

(52) U.S. Cl.
CPC ..... *F04B 43/073* (2013.01); *F04B 45/053* (2013.01); *F04B 53/14* (2013.01); *F04B 53/16* (2013.01)

(56) References Cited

U.S. PATENT DOCUMENTS

| | | | | |
|---|---|---|---|---|
| 5,391,060 | A * | 2/1995 | Kozumplik, Jr. | F04B 9/135 417/389 |
| 5,564,911 | A | 10/1996 | Santa | |
| 5,567,118 | A * | 10/1996 | Grgurich | F04B 43/0736 417/393 |
| 5,848,615 | A * | 12/1998 | Conti | F04B 53/1042 137/856 |
| 6,168,394 | B1 * | 1/2001 | Forman | F04B 43/0736 417/393 |
| 6,883,417 | B2 * | 4/2005 | Headley | F04B 43/0054 92/99 |
| 7,063,516 | B2 | 6/2006 | Bethel | |
| 8,845,305 | B2 * | 9/2014 | Santa | F04B 43/02 417/395 |
| 2004/0047749 | A1 * | 3/2004 | Roberts | F04B 43/0736 417/395 |
| 2007/0065305 | A1 * | 3/2007 | Budde | F04B 43/0736 417/395 |
| 2011/0103984 | A1 * | 5/2011 | Santa | F04B 43/02 417/472 |
| 2012/0036995 | A1 * | 2/2012 | Cochran | F04B 43/02 92/34 |
| 2013/0078125 | A1 | 3/2013 | Headley et al. | |

OTHER PUBLICATIONS

Examination Report No. 1 for Austrailian Patent Application No. 2014387814, dated Sep. 1, 2017, 5 pages.
Examination Report No. 1 for Australian Patent Application No. 2018201288, dated Dec. 5, 2018, 4 pages.
Chinese Office Action for Patent Application No. 201480076335.X, dated Apr. 29, 2019, 5 pages.
Chinese Office Action for Patent Application No. 201480076335.X, dated Sep. 21, 2018, 7 pages.
Chinese Office Action for Patent Application No. 201480076335.X, dated Jan. 2, 2018, 7 pages.

* cited by examiner

10

52
64
28
20
65
42
22
29
26
30
43
23
27
15
47
41
46
12
25
16
18
24
19
44
45
61
66
11
21
14
17
13
67
60

PRESSURISED FLUID DRIVEN DIAPHRAGM PUMP ASSEMBLY

CROSS-REFERENCE TO RELATED APPLICATIONS

This application is the U.S. national phase of PCT/AU2014/001106, filed on Dec. 9, 2014, which claims priority to Australian Patent Application No. 2014901080 filed on Dec. 9, 2014. The disclosures of both Australian Patent Application No. 2014901080 and PCT Application No. PCT/AU2014/001106 are hereby incorporated herein by reference in their entireties.

FIELD

The present invention relates to pump assemblies and more particularly but not exclusively to pump assemblies that include an air motor portion that drives a pump portion of the assembly.

BACKGROUND

Diaphragm pumps include a chamber that is divided by a piston and diaphragm so as to provide a first sub-chamber that receives a working fluid (liquid or gas) under pressure, and a second sub-chamber that receives a fluid being pumped. Usually the working fluid is compressed air. The working fluid under pressure is delivered to the first sub-chamber to cause reciprocation of the piston and diaphragm to vary the volume of the second sub-chamber, and thereby pump the fluid to be pumped by the assembly. These diaphragm pumps have an inlet and an outlet that communicate with the second sub-chamber via one-way valves so that the fluid being pumped passes in a predetermined direction through the pump assembly. A first manifold joins the inlet with the second sub-chamber while a second manifold joins the second sub-chamber with the outlet.

The above pump assemblies include a first body part providing the second sub-chamber, and a second body part providing the first sub-chamber. The first part provides for mounting of the one-way valves, while the diaphragm is held in position by being secured between the first and second body parts.

A disadvantage of the above described pump assemblies is that first part is generally an assembly and therefore requires gaskets, seals and securing means for its assembly. The disadvantage in that the construction is complex and time in respect of construction. This adds considerably to the cost of the pump assembly.

A further disadvantage of the above pump assemblies is resistance to flow of the pump fluid through the pump assembly.

A further disadvantage of the above assemblies is at least one of the pump parts have embedded in them bolts that protrude and are engaged by the other pump part. The use of these bolts inhibits efficient moulding of the pump parts.

Described in U.S. Pat. Nos. 5,564,911 and 6,834,678, and International Patent Applications PCT/AU2009/000199, PCT/AU2011/000226 and PCT/AU2014/000151 are pump assemblies relating to the present invention.

OBJECT

It is the object of the present invention to overcome or at least substantially ameliorate against one of the above disadvantages.

SUMMARY OF INVENTION

There is disclosed herein a pump assembly having:

a pump body providing a chamber;

a piston assembly mounted in the body for reciprocation relative to the body, and dividing the chamber into a first sub-chamber and a second sub-chamber;

first ducting, the first ducting being in communication with the first sub-chamber to provide for flow of a pumped fluid to and from the first sub-chamber;

second ducting, the second ducting being in communication with the second sub-chamber to provide for flow of a working fluid to and from the second sub-chamber to cause reciprocation of the piston assembly; and wherein the pump body includes a first body part and a second body part, the first body part cooperating with the piston assembly to provide the first sub-chamber, and the second body part cooperating with the piston assembly to provide said second sub-chamber, with said first body part having a chamber body portion and a duct body portion integrally formed with the chamber portion.

Preferably, the chamber body portion and duct body portion are integrally formed by being moulded from plastics material.

Preferably, the first body part includes an inlet valve seat and an outlet valve seat, with the first ducting communicating with the first and second valve seats to provide for the flow of the pumped fluid through the pump assembly.

Preferably, the pump assembly includes a first one-way valve and a second one-way valve, the first one-way valve being operatively associated with first valve seat, and the second one-way valve being operatively associated with the second valve seat, with the one-way valves providing for the flow of the pumped fluid in a predetermined direction through the pump assembly.

Preferably, flow through the first sub-chamber is downward.

There is further disclosed herein a pump assembly having a pump body providing a chamber;

a piston movably mounted in the body for reciprocation relative to the body, and dividing said chamber into a first sub-chamber and a second sub-chamber;

first ducting, said first ducting being in communication with the first sub-chamber via a first valve seat to provide for flow of a pumped fluid to and from the first sub-chamber;

second ducting, the second ducting being in communication with the second sub-chamber via a second valve seat to provide for flow of a working fluid to and from said second sub-chamber to cause reciprocation of the piston assembly; and wherein said body includes a first body part and a second body part, the first body part cooperating with the piston assembly to provide said first sub-chamber, and the second body part cooperating with said piston assembly to provide said second sub-chamber, with said first part having a chamber body portion and a duct body portion, with the first ducting including an inlet duct portion and an outlet duct portion, the inlet duct portion or the outlet duct portion including a first duct length extending from a valve seat, and a second duct length extending from the first duct length away from the valve seat, with the second duct length having a generally central longitudinal axis that is inclined by an acute angle to a plane within which said valve seat is located.

Preferably, the first duct length and the second duct length are provided by the inlet duct portion, and wherein the outlet duct portion includes a first duct length extending from a valve seat, and a second duct length extending from the first duct length of the second duct portion away from the valve seat of the second duct portion, with the second duct length of the outlet duct portion having a generally central longitudinal axis that is inclined by an acute angle to a plane within which the valve seat of the second duct portion is located.

Preferably, the assembly includes at least one mounting upon which the assembly is mounted or supported, with the valve seats being positioned so that flow to and from the first sub-chamber is substantially horizontal.

BRIEF DESCRIPTION OF DRAWINGS

Preferred forms of the present invention will now be described by way of example with reference to the accompanying drawings wherein.

DESCRIPTION OF EMBODIMENTS

Figure 1:
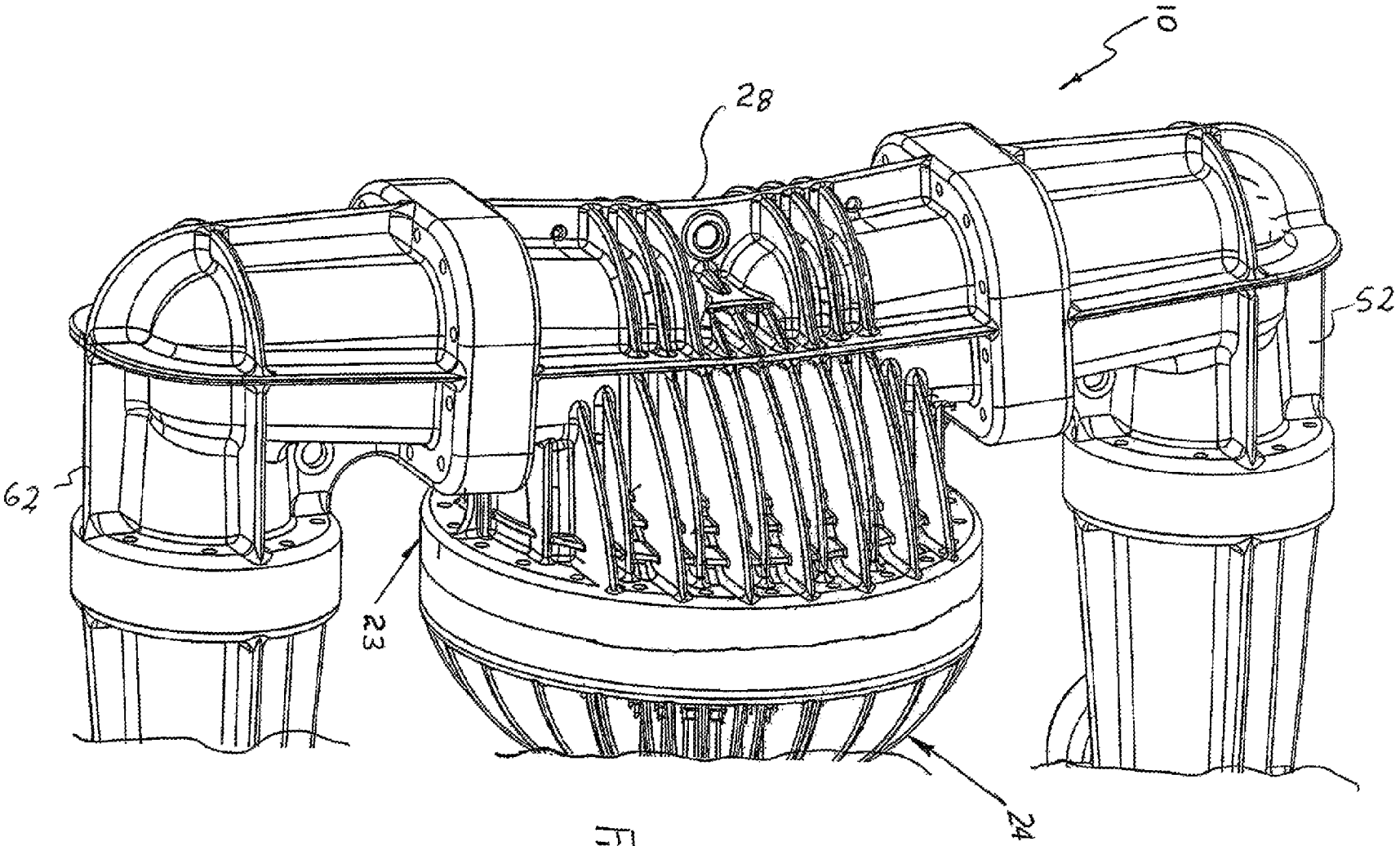
FIG. 1 is a schematic isometric view of a pump assembly.
Figure 2:
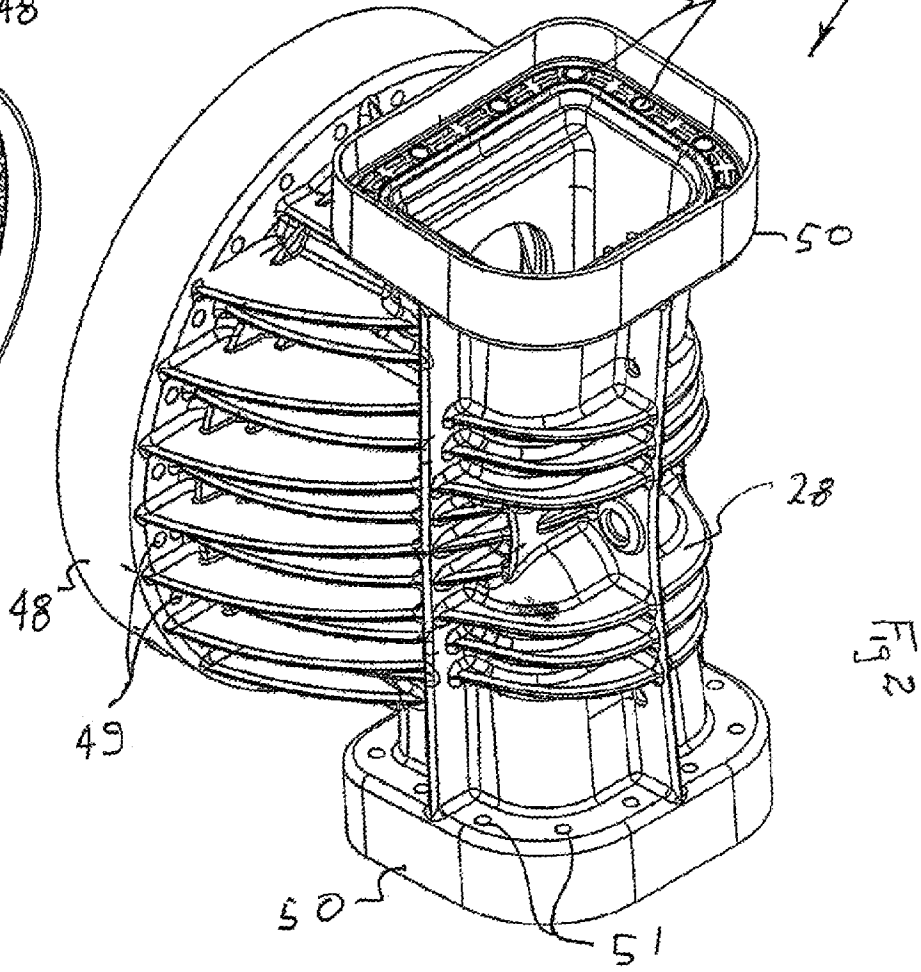
FIG. 2 is an isometric view of a body portion of the pump assembly of FIG. 1.
Figure 3:
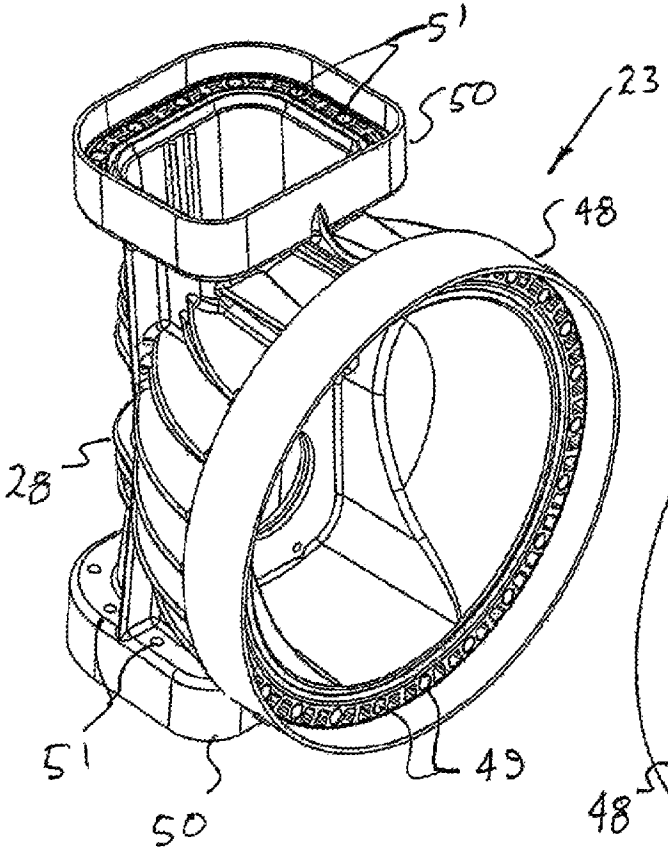
FIG. 3 is a schematic isometric view of the body portion of FIG. 1.

In the accompanying drawings there is schematically depicted a pump assembly 10. The pump assembly 10 is provided with compressed air, that acts as a driving fluid, to drive the pump assembly 10 to pump a liquid. The pump assembly 10 includes a pair of chambers 11 and 12, with each of the chambers 11 and 12 being divided into sub-chambers 13, 14 and 15, 16. A first piston assembly 17 divides the chamber 11 into sub-chambers 13 and 14, while a second piston assembly 18 divides the chamber 12 into sub-chambers 15 and 16.

Compressed air is alternately delivered to the chambers 14 and 16 by a valve assembly 19. The valve assembly 19 may be a valve assembly as described in the International Patent Applications mentioned above.

The compressed air delivered to the sub-chambers 14 and 16 causes the piston assemblies 17 and 18 to reciprocate linearly along the longitudinal axis 20 of a connecting rod 21. The connecting rod 21 couples the piston assemblies 17 and 18 so that the piston assemblies 17 and 18 reciprocate in unison.

Movement of the piston assemblies 17 and 18 varies the volume of the sub-chambers 13 and 15, to pump the liquid being delivered to the pump assembly 10.

The pump assembly 10 includes a body 22, with the body 22 providing first body parts 23 that surround the sub-chambers 13, and second body parts 24 that surround the sub-chambers 14 and 16. Each of the body parts 23 and 24 is moulded from plastics material. Each of the parts 23 provides a chamber body portion 25 that is essentially of an annular construction.

Mounted in each part 23, or integrally formed therewith, is a pair of valve seats 26 and 27. The valve seats 26 and 27 provide for the flow of liquid through the sub-chamber 13.

Each first part 23 includes a duct body portion 28 that is integrally formed with the adjacent chamber portion 25. Preferably the associated portions are integrally formed by being injection moulded.

Mounted in each first part 23 is a one-way inlet valve 64 including a movable valve 41 that pivots between an open and closed position with respect to the associated valve seat 26. Also mounted in each first part 23 is a one-way outlet valve 65 including a movable valve member 42 that pivots between an open and closed position with respect to the associated valve seat 27. The valve members 41 and 42 are moved between their open and closed positions by the flow of liquid through the pump assembly 10.

Providing an inlet duct 43 is an inlet manifold assembly 44 that receives the liquid being pumped via an inlet aperture 45. The duct 43 communicates with the duct portions 29.

Connected to the duct portion 28 is an exhaust manifold assembly 60 that receives the liquid being pumped from the chambers 13 and 15 and delivers the liquid to an outlet aperture 61. The assembly 60 provides an outlet duct 66.

Each piston assembly 17 and 18 includes a piston body 46 to which there is fixed a diaphragm 47, with the outer peripheral edges of each diaphragm 47 being clamped between adjacent portions of the first and second parts 23, 24.

The first pans 23, as mentioned previously, are each integrally formed from plastics material, more preferably are injected moulded from plastics material.

The first parts 23 are provided with an annular flange 48 that is provided with a plurality of passages 49 that are aligned with corresponding passages in the adjacent second part 24 so that threaded fasteners may pass through the aligned passages and tensioned to secure each first part 23 to its adjacent second part 24.

Each duct portion 28 is provided with a part generally square or rectangular flange 50, with each flange 50 being moulded with a plurality of passages 51 to be aligned with corresponding passages in the adjacent manifold portions 52 and 62 (provided by the manifold assemblies 44 and 60), with threaded fasteners passing through the aligned passages that are tensioned to secure the manifold portions 52 and 62 to the duct portions 28.

Each duct body portion 28 provides a duct inlet length 29 and a duct outlet length 30.

Each length 29 and 30 has a generally central longitudinal axis, inclined to a plane through the valve seats 26 and 27, by an acute angle 34 or 39.

Figure 4:
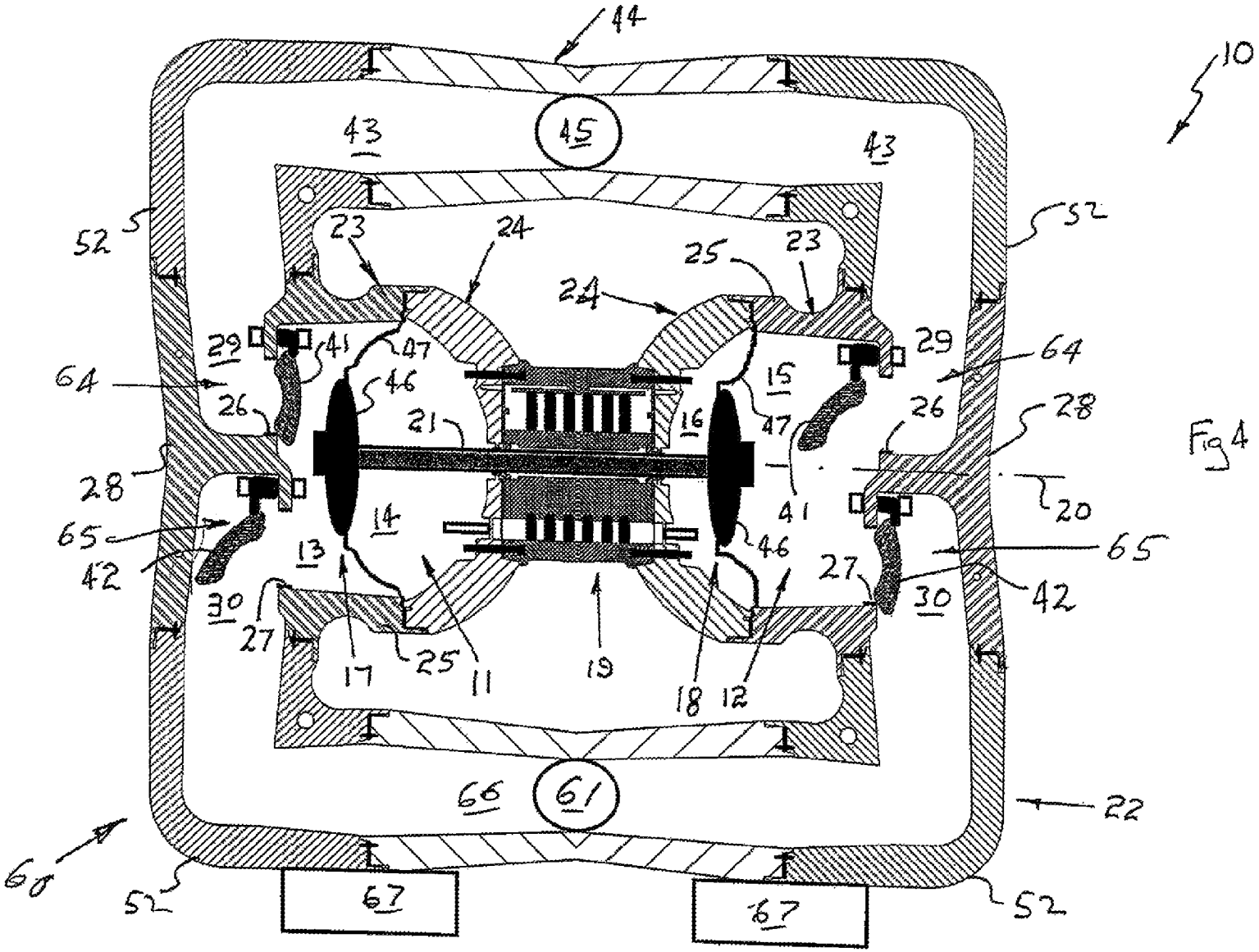
FIG. 4 is a schematic sectioned side elevation of the pump assembly of FIG. 1.
Figure 5:
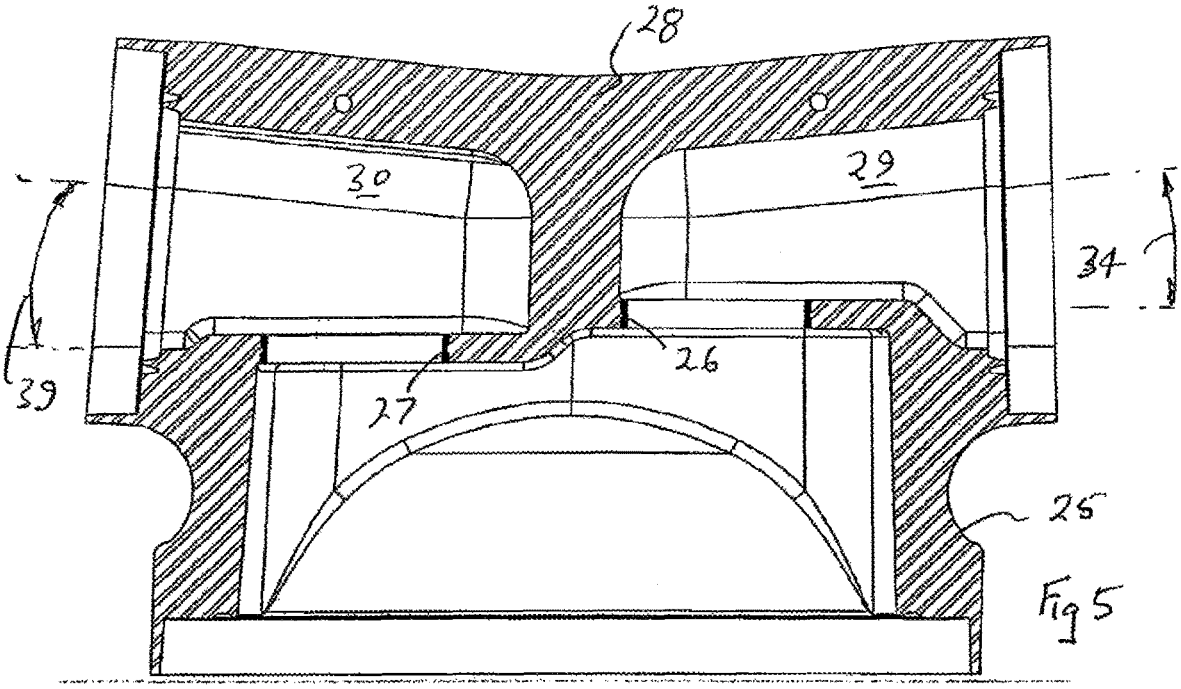
FIG. 5 is a schematic sectioned side elevation of portion of the assembly of FIG. 1.
Figure 6:
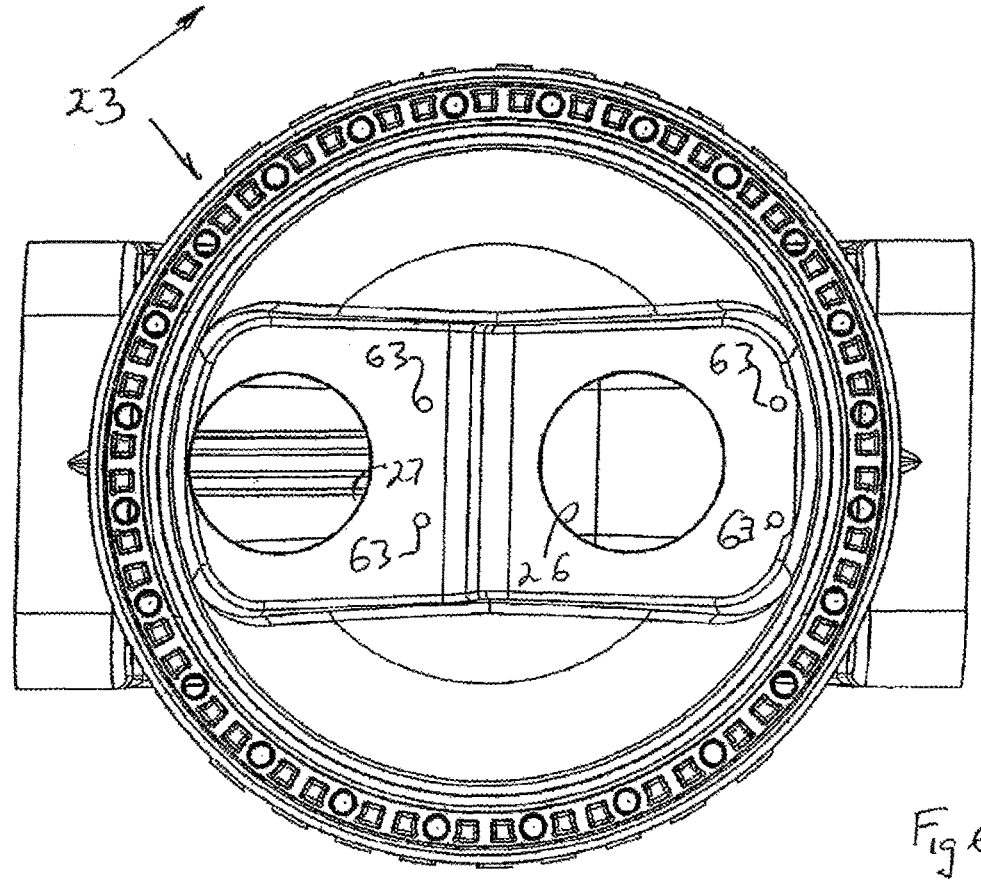
FIG. 6 is a schematic elevation of the portion of FIG. 5.

As best seen in FIG. 4, the pump assembly 10 includes a pair of mountings 67. The mountings 67 ensure that the pump assembly 10 is supported so that the valve seats 26 and 27 are located in substantially vertical planes. This in combination with the inclination of duct portions 29 and 30, ensure that the pump liquid entering and leaving the sub-chamber 13 passes in a substantially horizontal direction.

The valves 64 are above the valves 56, accordingly flow through the sub-chambers 13 and 15 is downward.

It should also be noted that each valve seat 27 is located in a substantially vertical plane that is positioned closer to the associated piston assembly 17, 18 than a substantially vertical plane within which the adjacent valve seat 26 is located.

The above described preferred embodiments have a number of advantages including the following:

(1) The first parts 23 are integrally formed from plastics material, thereby eliminating a significant number of seals and gaskets. This not only reduces the risk of leaks, but reduces assembly costs:

(2) The duct portions 29 and 30 are inclined by acute angles 34 and 39 to the valve seats 26, 27, enhancing flow to and from the sub-chambers 13 and 15;

(3) The first and second parts 23, 24, are provided with aligned passages 49 through which threaded fasteners pass to secure the parts 23 and 24 together. The same applies to the passages 51, of the parts 23, that are aligned with passages in the manifold portions 52 and 62 so that the threaded fasteners can pass therethrough to secure the portions 52 and 62 to the parts 23. By eliminating embedding of bolts in the moulded parts, the parts are more easily moulded;

(4) Each chamber body portion 25 is moulded with passages 63 through which bolts pass to secure each of the valves 64 in position. This enables more efficient moulding; and (5) As the duct portions 29 and 30 and valves 26 and 27 are positioned and configured to ensure that the pump liquid entering and leaving the sub-chambers 13 is generally horizontal, fluid flow through the sub-chambers 13 is enhanced.

The invention claimed is:

1. A pump assembly having:

a pump body providing a chamber;

a piston assembly movably mounted in the pump body for reciprocation relative to the pump body, and dividing said chamber into a first sub-chamber and a second sub-chamber;

first ducting, said first ducting being in communication with the first sub-chamber via first valve seats to provide for flow of a pumped fluid to and from the first sub-chamber in respective predetermined flow directions;

a working fluid valve assembly being in communication with the second sub-chamber to provide for flow of a working fluid to and from said second sub-chamber to cause reciprocation of the piston assembly; and wherein said pump body includes a first body part and a second body part, the first body part cooperating with the piston assembly to provide said first sub-chamber, and the second body part cooperating with said piston assembly to provide said second sub-chamber, with said first part having a chamber body portion integrally formed with a duct body portion, with the first ducting including an inlet duct portion and an outlet duct portion, the inlet duct portion and the outlet duct portion each including a duct length extending immediately from a respective one of the first valve seats in a direction away from the respective one of the first valve seats, wherein an interior wall of the duct length opposite from at least a center of said respective one of the first valve seats is inclined by an acute angle to a plane within which said respective one of the first valve seats is located so that the pump fluid passes immediately between each first valve seat and the respective duct length.

2. The pump assembly of claim 1, wherein the assembly includes at least one mounting upon which the assembly is mounted or supported, with the valve seats being positioned so that flow to and from the first sub-chamber is substantially horizontal.

3. The pump assembly of claim 1, wherein the first body part includes the first valve seats, one of the first valve seats defining an inlet valve seat and the other of the first valve seats defining an outlet valve seat, with the first ducting communicating with the inlet and outlet valve seats to provide for the flow of the pumped fluid through the pump assembly.

4. The pump assembly of claim 3, wherein the pump assembly includes a first one-way valve and a second one-way valve, the first one-way valve being operatively associated with the inlet valve seat, and the second one-way valve being operatively associated with the outlet valve seat, with the one-way valves providing for the flow of the pumped fluid in a predetermined direction through the pump assembly.

5. The pump assembly of claim 1, wherein flow through the first sub-chamber is downward.

6. A pump assembly comprising:

a pump body including a first body part coupled to a second body part to define a chamber therebetween;

a piston assembly movably mounted in the pump body for reciprocating motion relative to the pump body, the piston assembly dividing the chamber into a first sub-chamber and a second sub-chamber, the first body part cooperating with the piston assembly to provide the first sub-chamber, and the second body part cooperating with the piston assembly to provide the second sub-chamber;

an inlet valve coupled to the first body part and configured to allow a flow of a pumped fluid into the first sub-chamber, the inlet valve being a one-way valve;

an outlet valve coupled to the first body part and configured to allow the flow of the pumped fluid out of the first sub-chamber, the outlet valve being a one-way valve; and a working fluid valve assembly coupled to the second body part, the working fluid valve assembly configured to selectively provide a flow of a working fluid into and out of the second sub-chamber for driving the reciprocating motion of the piston assembly to provide the flow of the pumped fluid;

wherein the first body part includes a duct body portion and a chamber body portion extending from the duct body portion, the chamber body portion is formed integral and unitary with the duct body portion, the duct body portion defines an inlet duct length arranged for directing the flow of the pumped fluid into the first sub-chamber and an outlet duct length arranged for directing the flow of the pumped fluid out of the first sub-chamber, the first body part further defines an inlet valve seat between the inlet duct length and the chamber body portion and an outlet valve seat between the outlet duct length and the chamber body portion, and the inlet valve is coupled to the inlet valve seat inside of the chamber body portion and the outlet valve is coupled to the outlet valve seat inside the outlet duct length;

the inlet duct length and the outlet duct length extend in substantially opposite directions away from one another from the inlet valve seat and the outlet valve seat, respectively;

the inlet valve seat is arranged to lie in a first plane and the outlet valve seat is arranged to lie in a second plane, and wherein the first plane is parallel to the second plane;

an interior wall of the inlet duct length opposite from the inlet valve seat is inclined by an acute angle to the first plane, and wherein an interior wall of the outlet duct length opposite from the outlet valve seat is inclined by an acute angle to the second plane.

7. The pump assembly of claim 6, wherein the first body part is further formed to define first and second duct connectors arranged at opposite ends of the duct body portion, wherein the first duct connector is arranged at an obtuse angle to the first plane, and wherein the first duct connector is arranged at an obtuse angle to the second plane.

8. The pump assembly of claim 6, wherein a generally central longitudinal axis of the inlet duct length is inclined by an acute angle to the first plane, and wherein a generally central longitudinal axis of the outlet duct length is inclined by an acute angle to the second plane.

9. The pump assembly of claim 6, wherein the inlet duct length widens as the inlet duct length extends away from the inlet valve seat, and wherein the outlet duct length widens as the outlet duct length extends away from the outlet valve seat.

10. The pump assembly of claim 6, wherein the inlet valve and the outlet valve provide for the flow of the pumped fluid in a predetermined direction through the pump assembly.

11. The pump assembly of claim 6, wherein each of the inlet valve and the outlet valve are arranged to pivot relative to the respective inlet and outlet valve seats.

12. The pump assembly of claim 1, wherein the first body part is further formed to define first and second duct connectors arranged at opposite ends of the duct body portion and respectively associated with the inlet duct portion and the outlet duct portion, and at least one of the first and second connectors is arranged at an obtuse angle to the plane.

13. The pump assembly of claim 1, wherein a generally central longitudinal axis of the duct length is inclined by an acute angle to the plane.

14. The pump assembly of claim 1, wherein the duct length widens as the outlet duct length extends away from said respective one of the first valve seats.

15. The pump assembly of claim 4, wherein each of the first and second one-way valves are arranged to pivot relative to the respective inlet and outlet valve seats.

16. The pump assembly of claim 1, wherein the chamber body portion is formed integral and unitary with the duct body portion.

* * * * *